US006621226B2

(12) United States Patent
Kim et al.

(10) Patent No.: US 6,621,226 B2
(45) Date of Patent: Sep. 16, 2003

(54) MICROWAVE OVEN AND METHOD FOR CONTROLLING VOLTAGE THEREOF

(75) Inventors: Chul Kim, Anyang (KR); Sung-ho Lee, Suwon (KR); Young-won Cho, Suwon (KR); Tae-soo Kim, Seoul (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/920,621

(22) Filed: Aug. 3, 2001

(65) Prior Publication Data

US 2002/0125826 A1 Sep. 12, 2002

(30) Foreign Application Priority Data

Mar. 9, 2001 (KR) ..... 2001-12339

(51) Int. Cl.[7] ..... H05B 6/68
(52) U.S. Cl. ..... 315/105; 219/716; 363/98
(58) Field of Search ..... 219/715, 716; 363/98; 315/224, 219, 105

(56) References Cited

U.S. PATENT DOCUMENTS

| | | | | |
|---|---|---|---|---|
| 4,236,055 A | * | 11/1980 | Kaminaka | 219/685 |
| 5,317,133 A | * | 5/1994 | Sundstrom et al. | 219/716 |
| 5,321,235 A | * | 6/1994 | Makino et al. | 219/716 |
| 6,222,169 B1 | * | 4/2001 | Han et al. | 219/715 |

FOREIGN PATENT DOCUMENTS

| | | |
|---|---|---|
| JP | 5-74563 | 3/1993 |
| JP | 6-151054 | 5/1994 |
| JP | 7-298603 | 11/1995 |
| JP | 8-111290 | 4/1996 |
| JP | 8-140339 | 5/1996 |
| JP | 9-266626 | 10/1997 |
| JP | 10-191557 | 7/1998 |
| JP | 11-262247 | 9/1999 |
| KR | 84-2302 | 11/1984 |
| KR | 1992-0007540 | 9/1992 |
| KR | 0112647 | 10/1997 |
| KR | 1999-006267 | 1/1999 |
| KR | 20-0175716 | 1/2000 |
| KR | 2000-0033879 | 6/2000 |

* cited by examiner

*Primary Examiner*—David Vu
(74) *Attorney, Agent, or Firm*—Robert E. Bushnell, Esq.

(57) ABSTRACT

A microwave oven comprises a magnetron having an anode, a cathode and a filament, and a high voltage transformer having a primary coil and a secondary coil for supplying a high voltage to the magnetron. The microwave oven further comprises a capacitor connected in parallel to the secondary coil of the high voltage transformer, forming a resonance circuit with the secondary coil. With this configuration, the performance of the magnetron is maintained by lowering the anode peak voltage applied thereto during the early non-oscillating period, and the circuit elements are protected from damage by removing the surge voltage.

16 Claims, 5 Drawing Sheets

MICROWAVE OVEN AND METHOD FOR CONTROLLING VOLTAGE THEREOF

CLAIM OF PRIORITY

This application makes reference to, incorporates the same herein, and claims all benefits accruing under 35 U.S.C. §119 from an application for MICROWAVE OVEN AND VOLTAGE CONTROLLING METHOD THEREOF earlier filed in the Korean Industrial Property Office on Mar. 9, 2001 and there duly assigned Ser. No. 2001-12339.

BACKGROUND OF THE INVENTION

1. Field of the Invention

The present invention relates in general to a microwave oven and a method for controlling voltage thereof, and more particularly, a microwave oven and a method for controlling voltage thereof, which can lower an anode peak voltage applied to a magnetron during an early non-oscillating period, and remove a surge voltage.

2. Description of the Related Art

Generally, a microwave oven is, as shown in FIG. 4, comprised of a high voltage transformer 55 generating high voltage from external AC (alternating current) power, and a magnetron 51 generating electromagnetic waves.

The secondary part of the high voltage transformer 55 comprises two coils connected in parallel, and having different lengths relative to each other. Where AC power is supplied to the primary coil of the high voltage transformer 55, different voltages are respectively induced in the two coils of the secondary part thereof. In one of the two coils, there is induced a voltage of several volts for heating a filament of the magnetron 51, and in the other one, there is induced an AC pulse voltage of several thousands volts to be supplied to a cathode and an anode of the magnetron 51.

If the voltages induced from the high voltage transformer 55 heat the filament of the magnetron 51 and are supplied to the cathode and the anode of the magnetron 51, the magnetron 51 oscillates, to thereby generate electromagnetic waves.

In order to respectively supply DC (direct current) power to the cathode and the anode of the magnetron 51, in the secondary part of the high voltage transformer 55, there is installed a rectifying circuit. The rectifying circuit includes a rectifying diode 61 and a smoothing capacitor 62 which are connected in parallel with each other. The rectifying diode 61 rectifies the AC pulse voltage from the high voltage transformer 55, and the smoothing capacitor 62 smoothes the AC pulse voltage rectified by the rectifying diode 61.

In this conventional microwave oven, as illustrated in FIG. 5, there are problems in that a circuit element susceptible to voltage is damaged by a surge voltage generated at the beginning of magnetron operation or during the magnetron operation, etc.

Moreover, even if high voltage is respectively supplied to the cathode and the anode, the magnetron 51 does not oscillate until the filament is heated. However, when the magnetron 51 starts to operate, about 8,000 volts of anode peak voltage is supplied to the anode and the cathode until the filament is heated, namely, during a non-oscillating period. Because of the excessive high voltage supplied to the anode and the cathode during the early non-oscillating period, the performance of the magnetron 51 is lowered and the noise of the filament is instantaneously amplified. Further, because an excessive high voltage is supplied to the rectifying diode 61 in an inverse direction, the rectifying diode 61 can be damaged.

In order to solve these problems, in a conventional method, on the power input part of the high voltage transformer 55, there are installed a relay and a resistance which are connected in parallel with each other. At the beginning of supplying electric power, external AC power is supplied to the high voltage transformer 55 through the resistance by turning off the relay for a predetermined time. Then, the resistance can remove the surge voltage.

However, the manufacturing cost is raised because of the relay and the resistance. Also, if the relay is repeatedly turned on and off to operate the microwave oven, the contact of the relay may become defective and the resistance may be damaged. Further, the capacity of the rectifying diode 61 may be increased in order to prevent the rectifying diode 61 from being damaged, but there is a limit to the increase in the capacity.

SUMMARY OF THE INVENTION

Accordingly, the present invention has been made keeping in mind the above-described shortcoming and user's need, and an object of the present invention is to provide a microwave oven and a method for controlling voltage thereof, which can lower an anode peak voltage applied to a magnetron during an early non-oscillating period, and remove a surge voltage.

This and other objects of the present invention may be accomplished by the provision of a microwave oven comprising a magnetron having an anode, a cathode and a filament, and a high voltage transformer having a primary coil and a secondary coil for supplying a high voltage to the magnetron, further comprising a capacitor connected in parallel to the secondary coil of the high voltage transformer, forming a resonance circuit with the secondary coil.

Preferably, the secondary coil is comprised of a first coil part connected to the filament of the magnetron and a second coil part connected to the cathode and the anode of the magnetron; and the capacitor is connected in parallel to the second coil part.

Desirably, the secondary coil of the high voltage transformer is provided with a rectifying circuit, including a smoothing capacitor and a rectifying diode, and the smoothing capacitor is installed between the high voltage transformer and the rectifying circuit.

According to another aspect of the present invention, the above and other objects may be also achieved by the provision of a method for controlling voltage in a microwave oven comprising a magnetron and a high voltage transformer, the method including the steps of converting voltage supplied from an external source into a high voltage through the high voltage transformer, resonating the high voltage, and supplying the high voltage to the magnetron.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

A preferred embodiment of the present invention will be described in more detail with reference to the accompanying drawings.

Figure 1:
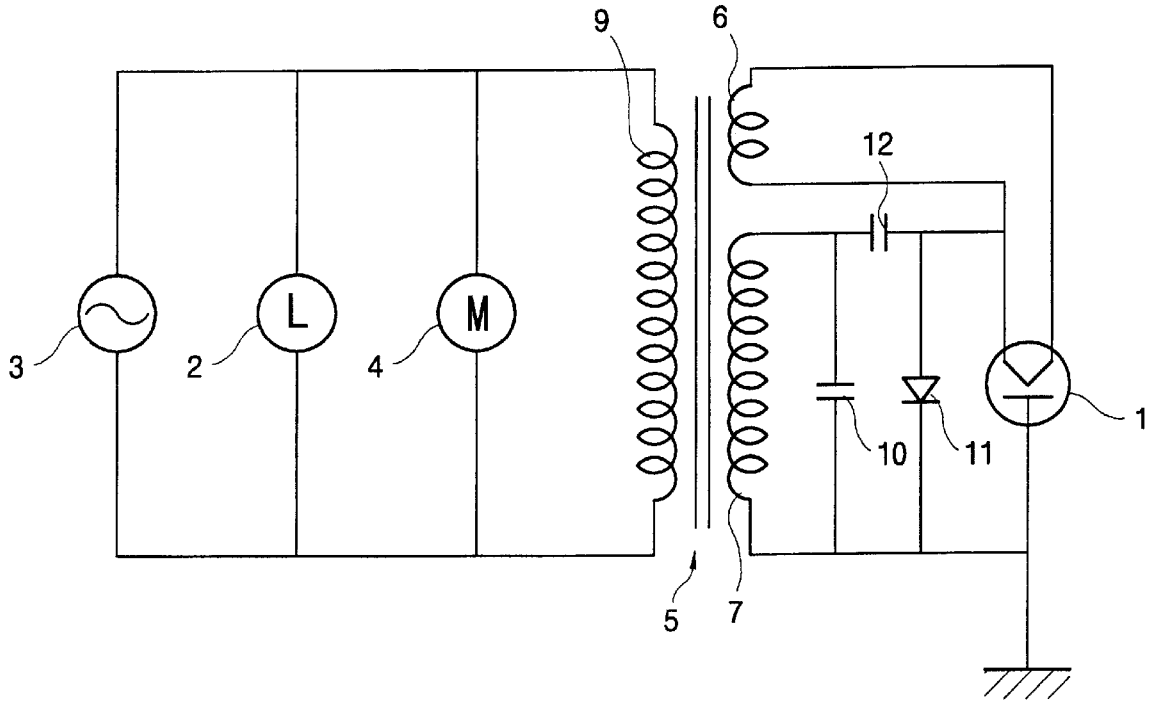
FIG. 1 is a circuit diagram of a microwave oven according to the present invention.

Referring to FIG. 1, a microwave oven according to the present invention is comprised of a power supply part 3, a high voltage transformer 5 generating a high voltage, and a magnetron 1 generating electromagnetic waves due to the high voltage generated by the high voltage transformer 5.

Between the power supply part 3 and a primary coil 9 of the high voltage transformer 5, there are provided a lamp 2 lighting up a cooking chamber (not shown), and a cooling fan motor 4 cooling the components including the high voltage transformer 5, the magnetron 1, etc. The lamp 2 and the cooling fan motor 4 are mutually connected in parallel.

A secondary coil of the high voltage transformer 5 is divided into two parts, first and second coil parts 6 and 7, respectively, which have different lengths relative to each other. In the first coil part 6, there is induced a voltage of several volts, and in the second coil part 7, there is induced a voltage of several thousands volts.

The magnetron 1 comprises an anode forming a cavity for resonance, a cathode located in the middle of the cavity for resonance, and a filament heating the cathode to emit electrons. The filament is connected to the first coil part 6 of the high voltage transformer 5, and the voltage of several volts is supplied thereto. The anode and the cathode are respectively connected to opposite ends of the second coil part 7, and the voltage of several thousands volts is supplied therebetween. This several thousands volts voltage is called an anode peak voltage.

The magnetron 1 generates electromagnetic waves by emitting electrons from the cathode, and by heating the filament as a result of the voltage supplied from the first coil part 6 of the high voltage transformer 5. The period from the time when the high voltage from the high voltage transformer 5 is supplied to the anode and the cathode to the time when the filament is heated is called an early non-oscillating period. The vohage between the anode and the cathode of the magnetron 1 during this period is called a non-oscillating anode peak voltage.

To the second coil part 7 of the secondary coil of the high voltage transformer 5, there is installed a rectifying circuit converting an AC high voltage supplied to the magnetron 1 into a DC high voltage. The rectifying circuit includes a smoothing capacitor 12 connected to one side of the second coil part 7, rectifying the AC high voltage, and a rectifying diode 11 installed on the line connecting the opposite ends of the second coil part 7.

Further, to the second coil part 7, there is connected a resonance capacitor 10 installed in parallel with the rectifying diode 11. The resonance capacitor 10 is installed on the line connecting opposite ends of the second coil part 7, and is also installed between the high voltage transformer 5 and the smoothing capacitor 12. The resonance capacitor 10 forms a resonance circuit, together with the second coil part 7, and charges the high voltage from the high voltage transformer 5. Preferably, the capacity of the resonance capacitor 10 is determined according to the capacity of the smoothing capacitor 12, and resonance capacitor 10 and smoothing capacitor 12 are preferably designed to minimize an electric current inputted to the resonance capacitor 10. In order to minimize the electric current inputted to the resonance capacitor 10, it is preferable that the ratio of the capacity of the smoothing capacitor 12 to the capacity of the resonance capacitor 10 is about 5:1 to 10:1.

Figure 2:
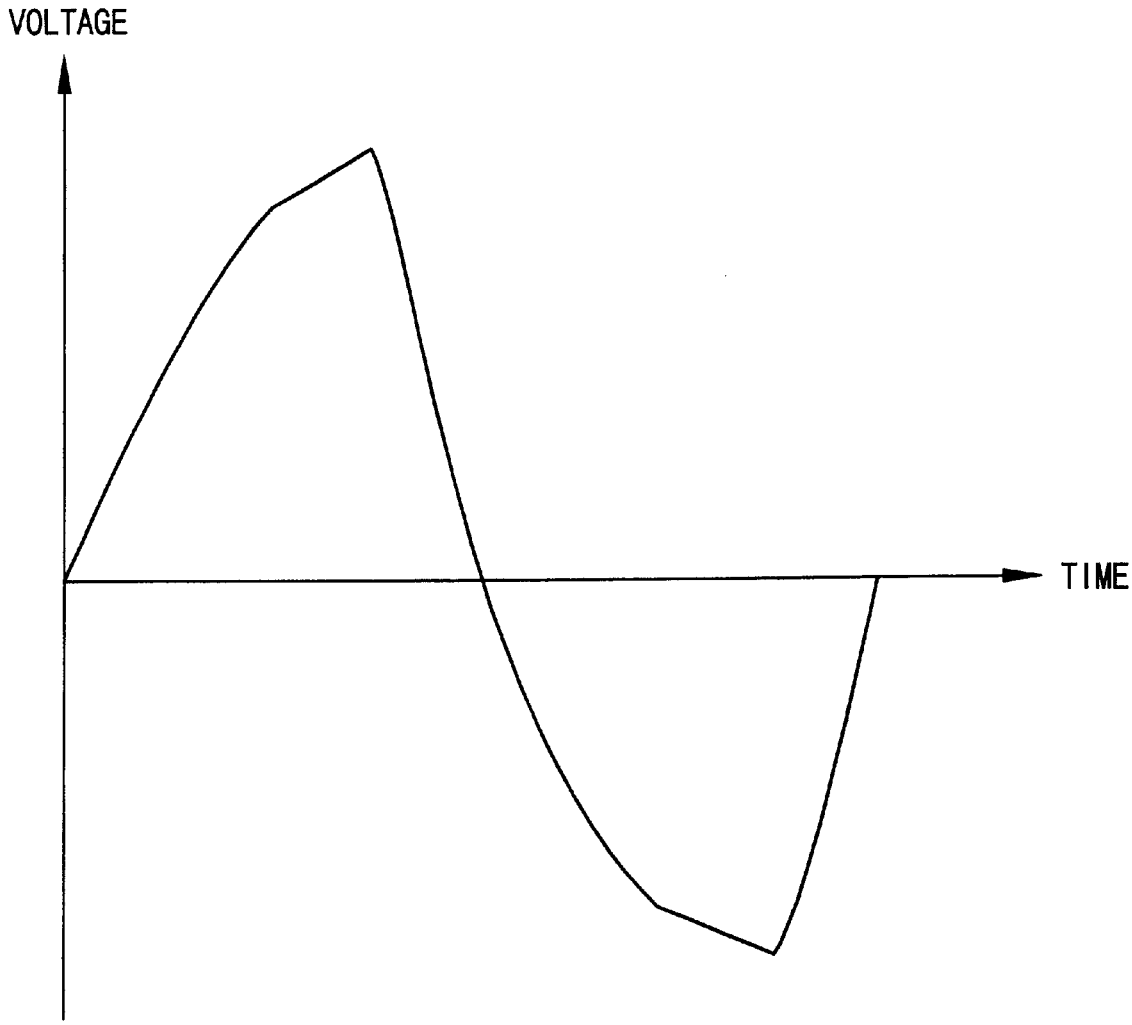
FIG. 2 is a graph of a voltage waveform supplied to a filament according to the circuit of FIG. 1.
Figure 3:
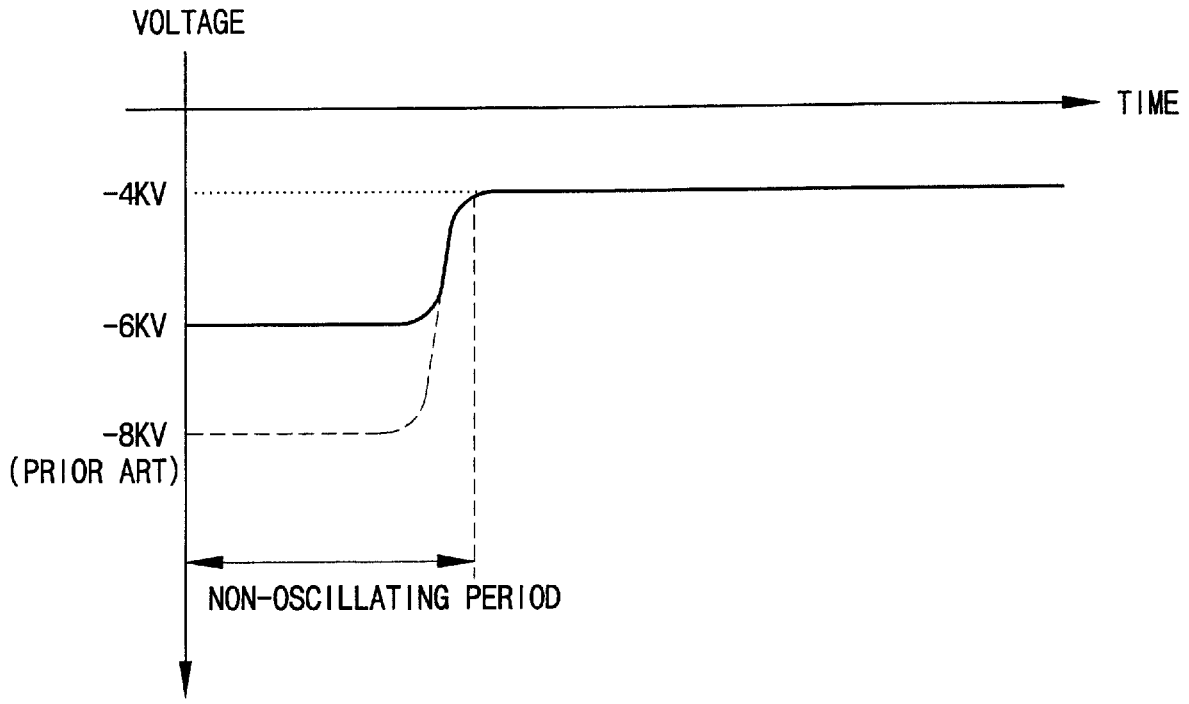
FIG. 3 is a graph of a voltage waveform supplied to a cathode according to the circuit of FIG. 1.
Figure 4:
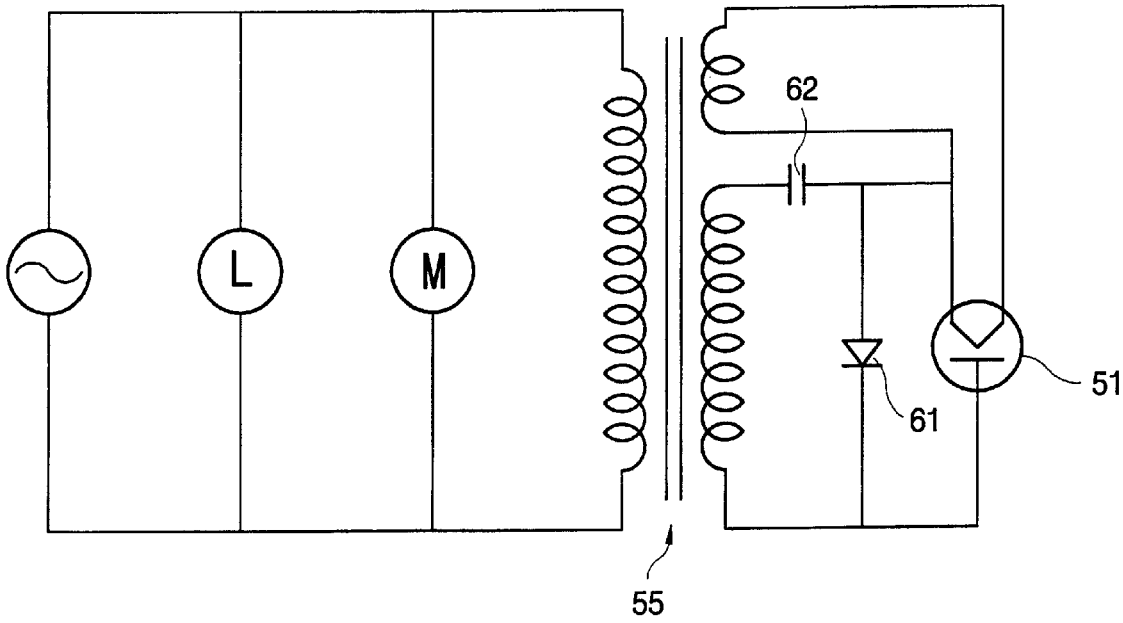
FIG. 4 (PRIOR ART)
FIG. 4 is a circuit diagram of a conventional microwave oven.
Figure 5:
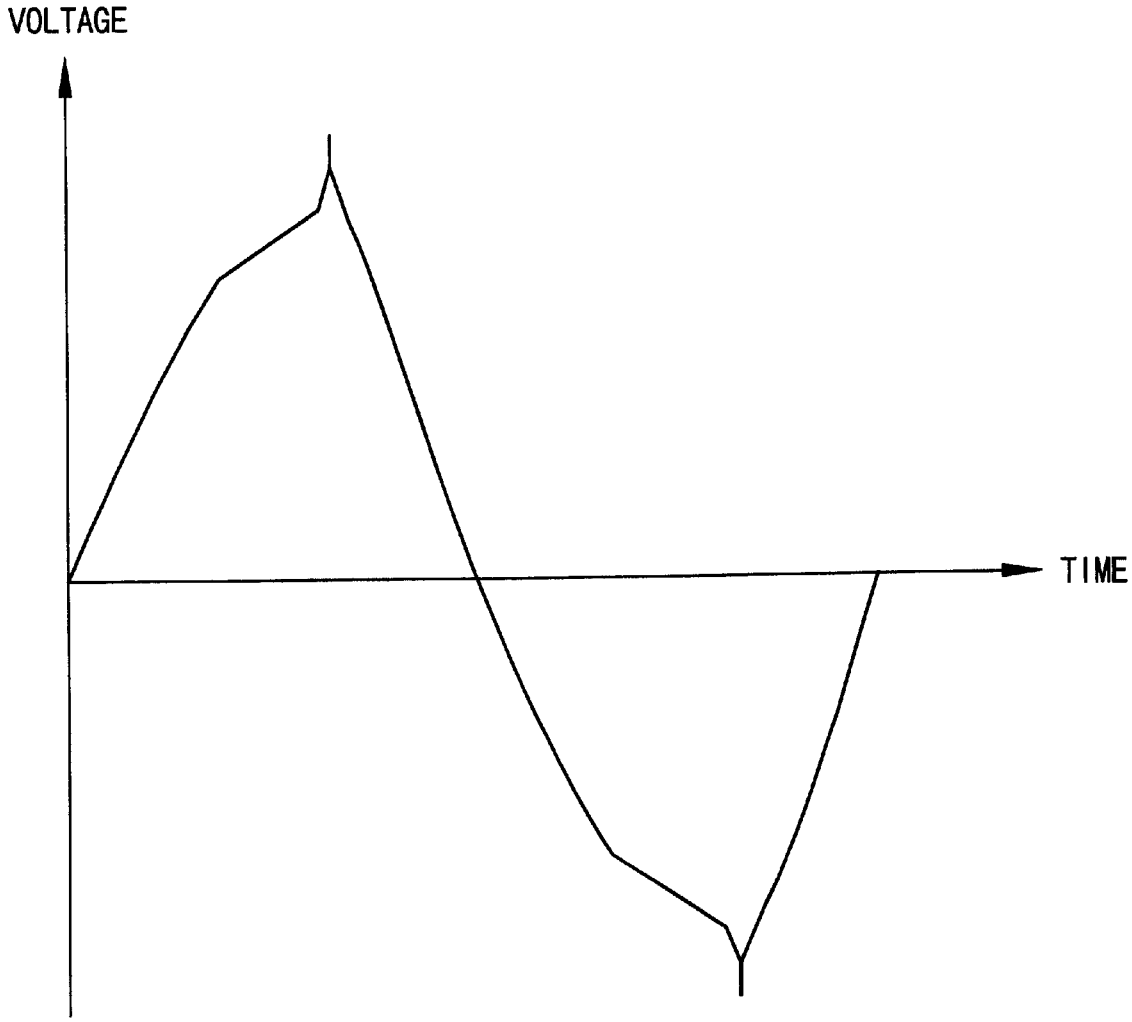
FIG. 5 (PRIOR ART)
FIG. 5 is a graph of a voltage waveform supplied to a filament according to the circuit of FIG. 4.

The resonance circuit formed by the resonance capacitor 10 connected to the second coil part 7 can delay supplying the high voltage to the cathode and the anode of the magnetron 1 through the second coil part 7 during the time of charging the resonance capacitor 10 with the high voltage. Accordingly, as depicted in FIG. 3, during the early non-oscillating period, the non-oscillating anode peak voltage supplied to the anode and the cathode of the magnetron 1 is lowered from about 8,000 V to about 6,000 V, and the voltage inversely supplied to the rectifying diode 11 is also lowered to about 6,000 V. Here, the anode peak voltage has a negative value because FIG. 3 shows the waveform of the voltage supplied to the cathode. Further, as shown in FIG. 2, a surge voltage supplied to the filament is also removed. Consequently, it is possible to prevent the filament from being damaged and to lower noise generated in the filament.

With this configuration, at the beginning of operating the microwave oven, if the power supply part 3 supplies electric power to the high voltage transformer 5, voltage of several volts and several thousands volts are induced in the first and second coil parts 6 and 7, respectively, of the secondary coil of the high voltage transformer 5. Subsequently, the voltage induced in the second coil part 7 charges the resonance capacitor 10 and is rectified through the smoothing capacitor 12 and the rectifying diode 11. Then, the rectified voltage is supplied to the cathode and the anode of the magnetron 1. Simultaneously, the voltage induced in the first coil part 6 of the high voltage transformer 5 is supplied to the filament with the surge voltage being removed. During the non-oscillating period when the filament is heated, the high voltage supplied to the cathode and the anode through the second coil part 7 is lowered by the resonance capacitor 10. That is, the non-oscillating anode peak voltage supplied to the cathode and the anode during the early non-oscillating period is lowered to about 6,000 V. Thereafter, when the filament is heated enough, the anode peak voltage supplied to the cathode and the anode is lowered to about 4,000 V. Then, the cathode emits electrons to thereby generate electromagnetic waves.

Thus, the microwave oven according to the present invention has the resonance capacitor 10 connected to the secondary coil of the high voltage transformer 5 so as to prevent a malfunction in advance by lowering the voltage supplied to the magnetron 1. That is, the resonance capacitor 10 lowers the non-oscillating anode peak voltage during the early non-oscillating period of the magnetron 1, to thereby maintain the performance of the magnetron 1 and prolong the durability thereof. Further, because the high voltage inversely supplied to the rectifying diode 11 is lowered, not only is the rectifying diode 11 protected from damage, but also circuit elements including the rectifying diode 11 connected to the secondary coil of the high voltage transformer 5 can be used in a low voltage. In addition, at the beginning of supplying electric power, the surge voltage passing through the high voltage transformer 5 is removed, and then the waveform of the voltage supplied to the ifiament is stabilized. Therefore, the noise generated from the filament is decreased.

As described above, according to the present invention, the performance of the magnetron is maintained by lowering the anode peak voltage applied thereto during the early non-oscillating period, and the circuit elements are protected from damage by removing the surge voltage.

Although the preferred embodiments of the present invention have been disclosed for illustrative purposes, those skilled in the art will appreciate that various modifications, additions and substitutions are possible without departing from the scope and spirit of the invention, as recited in the accompanying claims.

What is claimed is:

1. A method for controlling voltage in a microwave oven which includes a magnetron, said method comprising:

providing a high voltage transformer which includes a secondary coil which has a first coil part and a second coil part;

supplying a voltage from an external source to the high voltage transformer so as to induce a low voltage in the first coil part and a high voltage in the second coil part;

applying the high voltage from the second coil part as an anode peak voltage between an anode and a cathode of the magnetron, thereby commencing an early non-oscillating period of the magnetron;

supplying the low voltage from the first coil part to a filament of the magnetron so as to provide a stabilized voltage to heat the filament during the early non-oscillating period of the magnetron;

lowering the anode peak voltage to a first level during the early non-oscillating period of the magnetron;

terminating the early non-oscillating period of the magnetron once the filament is heated to a certain degree; and lowering the anode peak voltage to a second level, lower than the first level, when the early non-oscillating period of the magnetron is terminated.

2. The method of claim 1, further comprising, during the applying of the high voltage from the second coil part as an anode peak voltage between the anode and the cathode of the magnetron, charging a resonance capacitor using the high voltage from the second coil part.

3. The method of claim 2, further comprising, prior to applying the high voltage from the second coil part as an anode peak voltage between the anode and the cathode of the magnetron, rectifying the high voltage from the second coil part so as to convert it from alternating current to direct current for application between the anode and the cathode of the magnetron.

4. The method of claim 3, further comprising, prior to supplying the low voltage from the first coil part to the filament of the magnetron, removing a surge voltage from the low voltage.

5. The method of claim 2, further comprising, prior to supplying the low voltage from the first coil part to the filament of the magnetron, removing a surge voltage from the low voltage.

6. The method of claim 1, further comprising, prior to applying the high voltage from the second coil part as an anode peak voltage between the anode and the cathode of the magnetron, rectifying the high voltage from the second coil part so as to convert it from alternating current to direct current for application between the anode and the cathode of the magnetron.

7. The method of claim 6, further comprising, prior to supplying the low voltage from the first coil part to the filament of the magnetron, removing a surge voltage from the low voltage.

8. The method of claim 1, further comprising, prior to supplying the low voltage from the first coil part to the filament of the magnetron, removing a surge voltage from the low voltage.

9. The method of claim 1, further comprising charging a resonance capacitor using the high voltage from the second coil part, while delaying the applying of the high voltage from the second coil part as an anode peak voltage between the anode and the cathode of the magnetron during charging of the resonance capacitor.

10. A method for controlling voltage in a microwave oven which includes a magnetron, said method comprising:

providing a high voltage transformer which includes a secondary coil which has a first coil part and a second coil part;

supplying a voltage from an external source to the high voltage transformer so as to induce a low voltage in the first coil part and a high voltage in the second coil part;

applying the high voltage from the second coil part as an anode peak voltage between an anode and a cathode of the magnetron, thereby commencing an early non-oscillating period of the magnetron;

supplying the low voltage from the first coil part to a filament of the magnetron so as to provide a stabilized voltage to heat the filament during the early non-oscillating period of the magnetron; and terminating the early non-oscillating period of the magnetron once the filament is heated to a certain degree.

11. The method of claim 10, further comprising lowering the anode peak voltage to a first level during the early non-oscillating period of the magnetron.

12. The method of claim 11, further comprising lowering the anode peak voltage to a second level, lower than the first level, when the early non-oscillating period of the magnetron is terminated.

13. The method of claim 12, further comprising, prior to applying the high voltage from the second coil part as an anode peak voltage between the anode and the cathode of the magnetron, rectifying the high voltage from the second coil part so as to convert it from alternating current to direct current for application between the anode and the cathode of the magnetron.

14. The method of claim 11, further comprising, prior to applying the high voltage from the second coil part as an anode peak voltage between the anode and the cathode of the magnetron, rectifying the high voltage from the second coil part so as to convert it from alternating current to direct current for application between the anode and the cathode of the magnetron.

15. The method of claim 10, further comprising, prior to applying the high voltage from the second coil part as an anode peak voltage between the anode and the cathode of the magnetron, rectifying the high voltage from the second coil part so as to convert it from alternating current to direct current for application between the anode and the cathode of the magnetron.

16. The method of claim 10, further comprising charging a resonance capacitor using the high voltage from the second coil part, while delaying the applying of the high voltage from the second coil part as an anode peak voltage between the anode and the cathode of the magnetron during charging of the resonance capacitor.

* * * * *